US007275337B2

(12) United States Patent
Zanatta et al.

(10) Patent No.: US 7,275,337 B2
(45) Date of Patent: Oct. 2, 2007

(54) SHOE WITH A COMPOSITE INSOLE

(75) Inventors: Marco Zanatta, Nervesa della Battaglia (IT); Giovanni Martini, Nervesa della Battaglia (IT); Lino Bernadel, Nervesa della Battaglia (IT)

(73) Assignee: Asolo SpA, Treviso (IT)

( * ) Notice: Subject to any disclaimer, the term of this patent is extended or adjusted under 35 U.S.C. 154(b) by 0 days.

(21) Appl. No.: 11/238,402

(22) Filed: Sep. 29, 2005

(65) Prior Publication Data

US 2006/0016099 A1 Jan. 26, 2006

Related U.S. Application Data

(63) Continuation of application No. PCT/EP2004/005018, filed on May 11, 2004.

(30) Foreign Application Priority Data

Jul. 14, 2003 (IT) ..... TV2003A0095

(51) Int. Cl.
*A43B 13/38* (2006.01)

(52) U.S. Cl. ..... 36/44; 36/30 R

(58) Field of Classification Search ..... 36/3 B, 36/28, 44, 141–144, 30 R, 30 A
See application file for complete search history.

(56) References Cited

U.S. PATENT DOCUMENTS

| | | | | |
|---|---|---|---|---|
| 1,194,152 | A * | 8/1916 | Douglas | 36/28 |
| 2,534,462 | A * | 12/1950 | Lumbard | 36/12 |
| 4,603,493 | A * | 8/1986 | Eston | 36/44 |
| 4,718,179 | A * | 1/1988 | Brown | 36/44 |
| 4,841,647 | A * | 6/1989 | Turucz | 36/44 |
| 4,879,821 | A * | 11/1989 | Graham et al. | 36/44 |
| 4,942,679 | A * | 7/1990 | Brandon et al. | 36/102 |
| 6,233,847 | B1 * | 5/2001 | Brown | 36/44 |
| 6,732,456 | B2 * | 5/2004 | Hussain | 36/144 |
| 2003/0061736 | A1 | 4/2003 | Polifroni | |

FOREIGN PATENT DOCUMENTS

| | | |
|---|---|---|
| DE | 35 27 583 | 2/1987 |
| DE | 92 01 704.5 | 8/1992 |
| DE | 197 02 978 | 7/1998 |
| EP | 0 799 583 | 10/1997 |

OTHER PUBLICATIONS

International Search Report dated Sep. 23, 2004.
Written Opinion of the International Searching Authority dated Sep. 23, 2004.
John Degaspari, "Sole Mates" Mechanical Engineering , 2001, http://www.memagazine.org/backissues/membersonly/may01/features/sole/sole.html.

* cited by examiner

*Primary Examiner*—Ted Kavanaugh
(74) *Attorney, Agent, or Firm*—Katten Muchin Rosenman LLP

(57) ABSTRACT

Shoe comprising an upper (30), a sole (50) and an insole (40; 140), characterized in that it uses an insole (40) formed by at least one element (20; 120) of soft material joined on top of an element (10; 110) of rigid material.

5 Claims, 4 Drawing Sheets

SHOE WITH A COMPOSITE INSOLE

CROSS REFERENCE TO RELATED APPLICATION

This application is a continuation of International Application PCT/EP2004/005018 which was filed on May 11, 2004, now PCT Publication No. WO 2005/004658 and claims priority from Italian Patent Application No. TV2003 A 000095 filed Jul. 14, 2003, the contents of which are herein wholly incorporated by reference.

It is known that persons practicing sport or undertaking excursions on rough ground require a shoe with special characteristics. Said shoe must not only protect the foot from any knocks or deformations, for which reason it must have a rigid structure, but it must also have a system which allows one to walk or run comfortably, namely a system for absorbing the stresses acting on the foot. Equally importantly, again in order to ensure greater comfort and avoid fatigue, the shoe must be able to adapt its shape to that of the foot of the person using it, whence the use of soft and deformable materials.

As regards the problem of rigidity, a solution can be found in Italian Utility Model No. 00235310 and consists in providing, integrally on the bottom surface of the rigid insole of the shoe, a number of longitudinally extending ribs of varying geometrical form, in order to increase both the torsional and flexural rigidity.

Another already known solution relates to a special shape of the outer sole, i.e. the sole which makes contact with the ground. In this case, the upper surface of the said sole is provided with vertical elements which are parallel or frustoconical and form a relief of a few millimeters height on the inner part of the heel or the outer part of the sole of the foot. The aim is to provide the foot with greater support during movement so as to lessen, respectively, the problem of pronation (an incorrect posture of the foot which results in displacement of the body weight onto the inner side of the foot) and the problem of supination (body weight displaced onto the outer side of the foot).

A drawback of the first solution is the lack of comfort of the user who has to rest his/her foot on a rigid surface. In order to overcome this problem, additional inner sole, normally made of expanded and breathable material, may be inserted inside the shoe, said additional sole being either glued or in most cases being extractable in order to allow replacement thereof. However, this possibility does not ensure an adequate degree of comfort since this additional sole, in addition to not ensuring really effective damping of the stresses, with time comes loose, tears or becomes puckered and prevents the foot gripping the shoe properly. As regards the second mentioned solution, on the other hand, its effects are reduced owing to the fact that other layers of material are arranged between the reinforcing elements and the sole of the foot, thus limiting substantially the effectiveness of the said elements.

The object of the present invention is to provide an insole for shoes which provides the said shoe both with the rigidity required by demanding activities and with an adequate degree of comfort.

This object is achieved with a composite insole which consists of two elements which can be joined together and comprises a bottom element of rigid material provided with upwardly projecting reliefs having the same function as those described above for the shoe soles and an upper element consisting of expanded material preferably injected onto the first element and forming the surface for supporting the foot.

In this way the expanded material of the upper element provides the foot with a soft support; the bottom element in turn, which ensures the solidity of the insole, exploits substantially the functional effect of the reliefs since the latter are now situated closer to the sole of the foot; in this way both pronation and supination are prevented in an effective manner.

These and further advantages will emerge more clearly from the following description of a preferred embodiment of the insole, provided by way of a nonlimiting example, with reference to the accompanying drawings in which.

Figure 1:
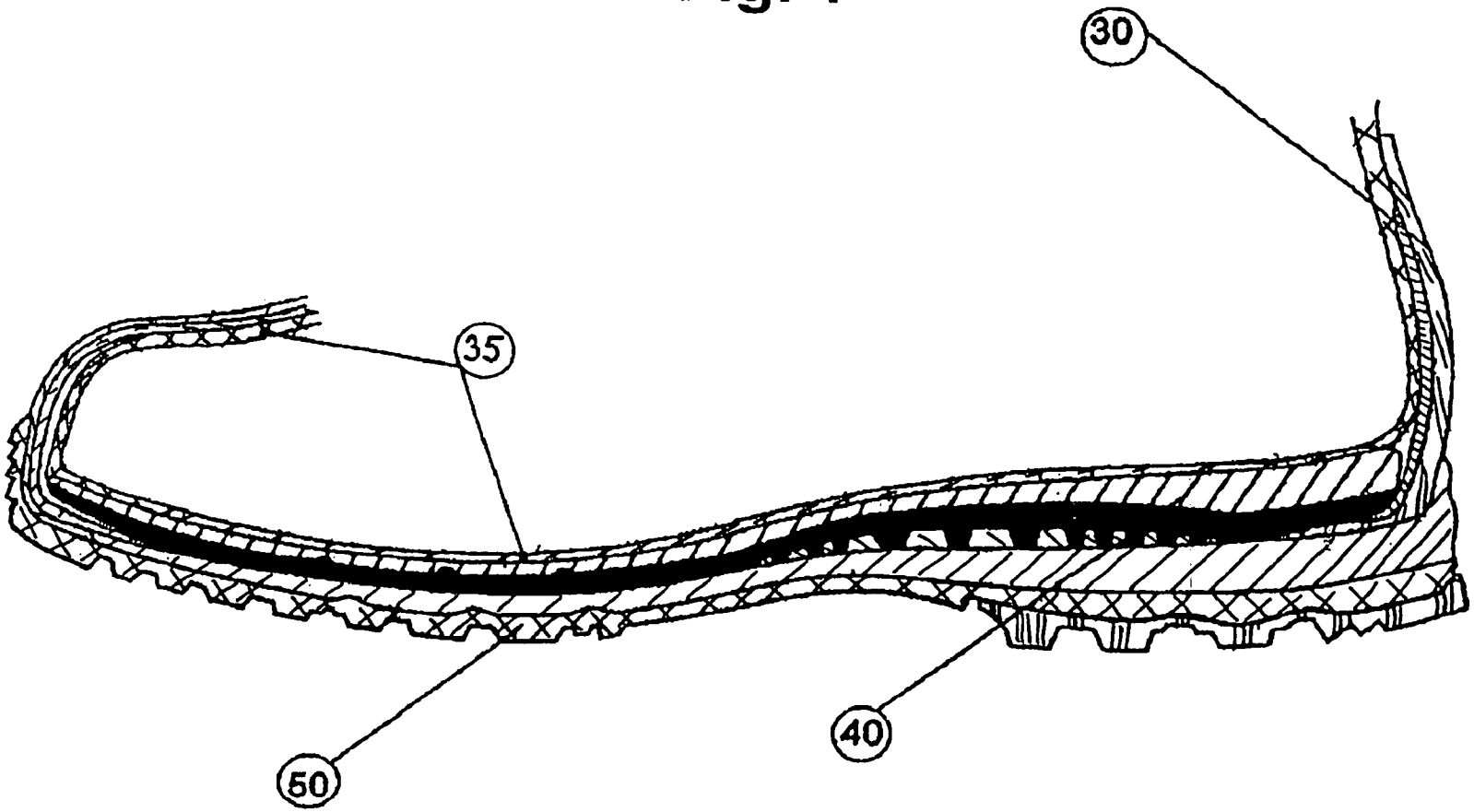
FIG. 1 shows a longitudinal cross-section through a shoe comprising an insole according to the invention.
Figure 2:
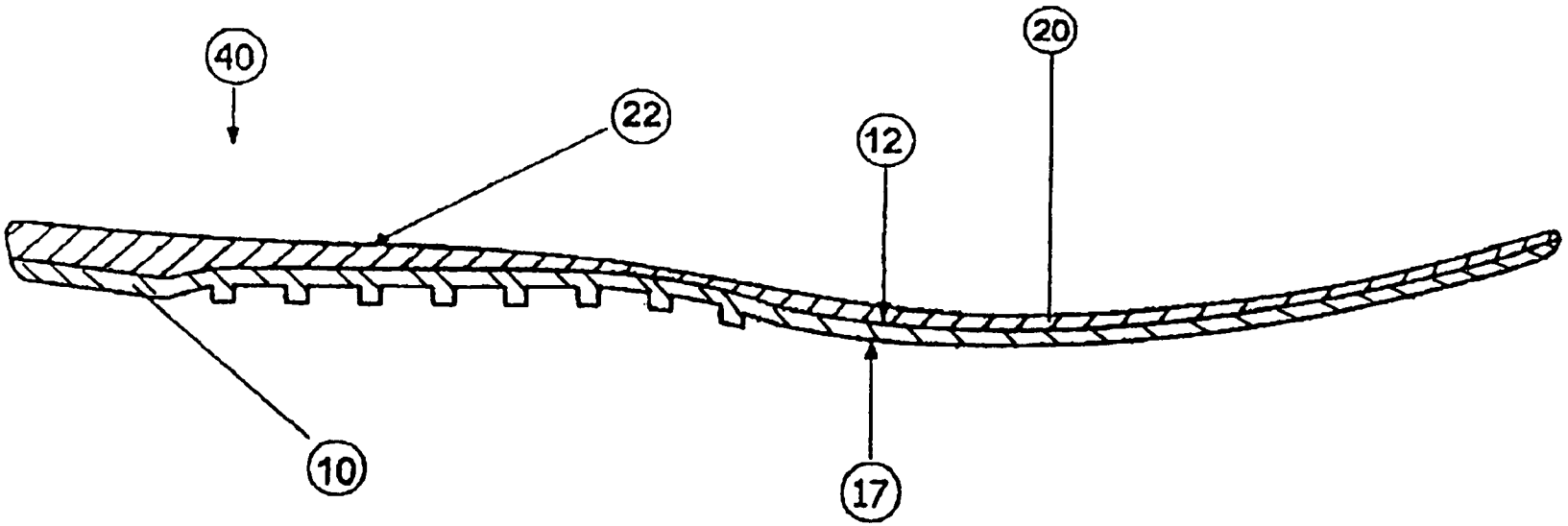
FIG. 2 shows a longitudinal cross-section through the insole comprising both the abovementioned elements, i.e. the soft upper element and the rigid bottom element.

With reference to FIG. 1, this shows a cross-section through a shoe comprising, in addition to an upper 30 and an outer sole 50 provided with a tread, a composite insole which is denoted overall by the reference number 40 and consists of a rigid bottom element 10 and a soft upper element 20. The insole 40 is inserted into the upper 30 and inseparable from the upper since it is positioned underneath the inner sheath 35 of the shoe. In other words, the shoe is manufactured in a manner to incorporate the insole 40. The rigid bottom element 10 has a lower surface 17 intended to fit against the outer sole 50 of the shoe in such a way to cover the peripheral edge where the upper is fastened to the said outer sole.

Figure 3:
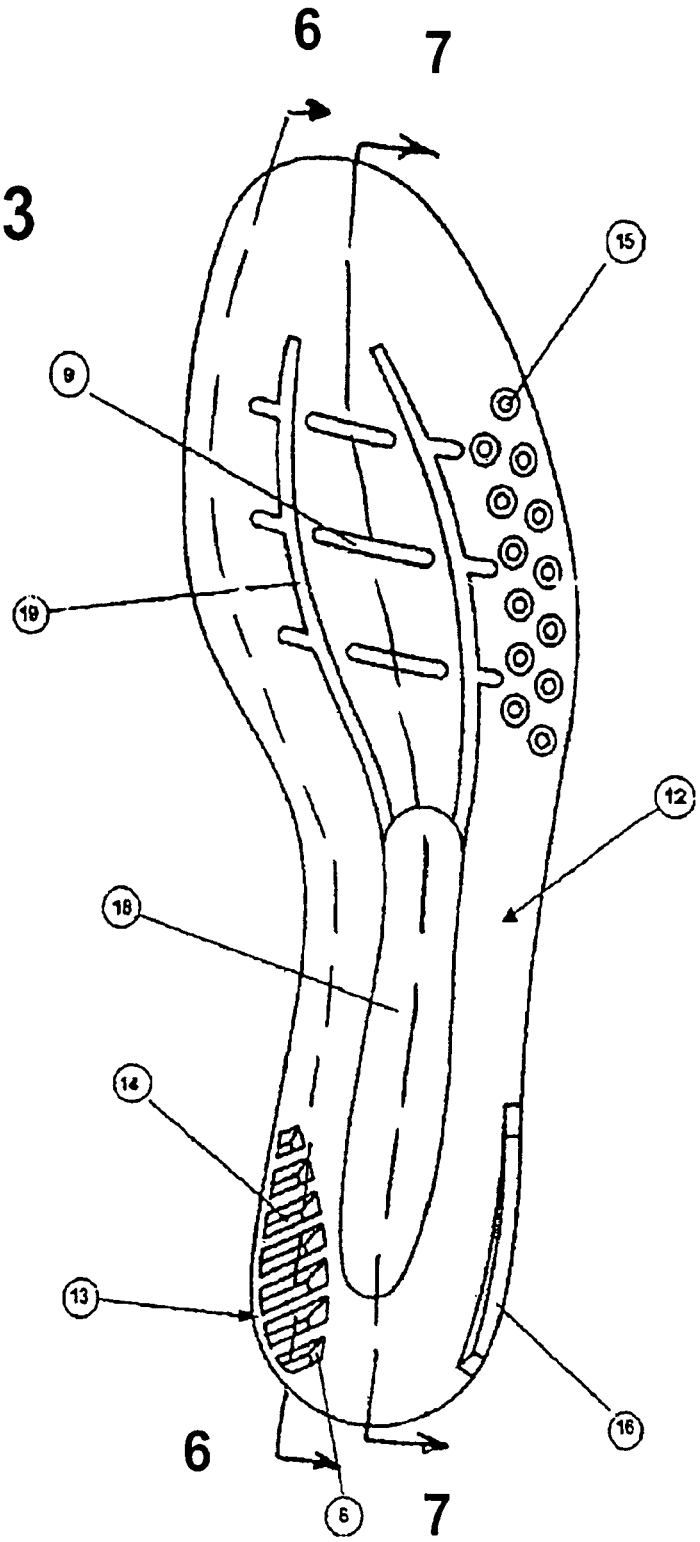
FIG. 3 shows a top plan view of the rigid element which forms part of the insole according to FIG. 2.

The upper surface 12 of the rigid bottom element 10 has different parts in relief with specific functions. In the region of the heel, a row 13 of transverse lugs 14 which are substantially vertical and inclined with respect to the longitudinal centre plane of the shoe project from the said upper surface 12. In this embodiment of the invention the section 8 of the lugs 14 which is directed towards the inside of the shoe has a chamfered surface—see FIG. 3. The function of the transverse lugs 14 is that of rigidly supporting the heel of the person using the shoe so as to prevent pronation of the foot.

In a position opposite to said row 13 of lugs 14, again in the region of the heel, a further lug 16 projects from the said surface 12, said lug being profiled so as to follow the contour of the rigid element 10 and therefore being substantially longitudinal. The function of the longitudinal lug 16, which forms a side wall of limited height, will be clarified below. The upper surface 12 of the rigid element 10 is moreover provided with a plurality of ribs 19 which are arranged substantially longitudinally, a plurality of transverse ribs 9 and a plurality of projections 15. In this embodiment of the invention, the projections 15 have a frustoconical form and are concentrated along the outer edge of the forefoot, being arranged in two or more non-aligned rows. The ribs 9 and 19, in addition to their reinforcing and anti-torsional function in the zone of the metatarsus, cooperate with the projections 15 in supporting the front portion of the foot sole so as to prevent supination of the foot. Finally, the body of the rigid element 10 has an enlarged central portion 18 of convex shape, which has the function of torsionally reinforcing the zone of the foot arch.

The second element of the composite insole 40 consists of a soft element 20 which is made of expanded materials such as rubber, polyurethane or the like and comprises an upper surface 22 which is shaped in an anatomically comfortable manner.

In the preferred embodiment of the invention which is described here, the rigid element 10 and the soft element 20 are joined together permanently so as to form one piece, owing also to the retaining effect which the longitudinal lug 16 has on the outside of the insole. For the said joining purpose the rigid element 10 is firstly obtained by means of injection into a special mould and then the soft material of the element 20 is injected over its upper surface 12.

From the description given it is evident that the composite insole achieves the object indicated above and may be made using methods and materials which are well-known. The thus formed subassembly can be attached, using any known technology, to the other parts (upper and outer sole) of the shoe.

Figures 4, 5:
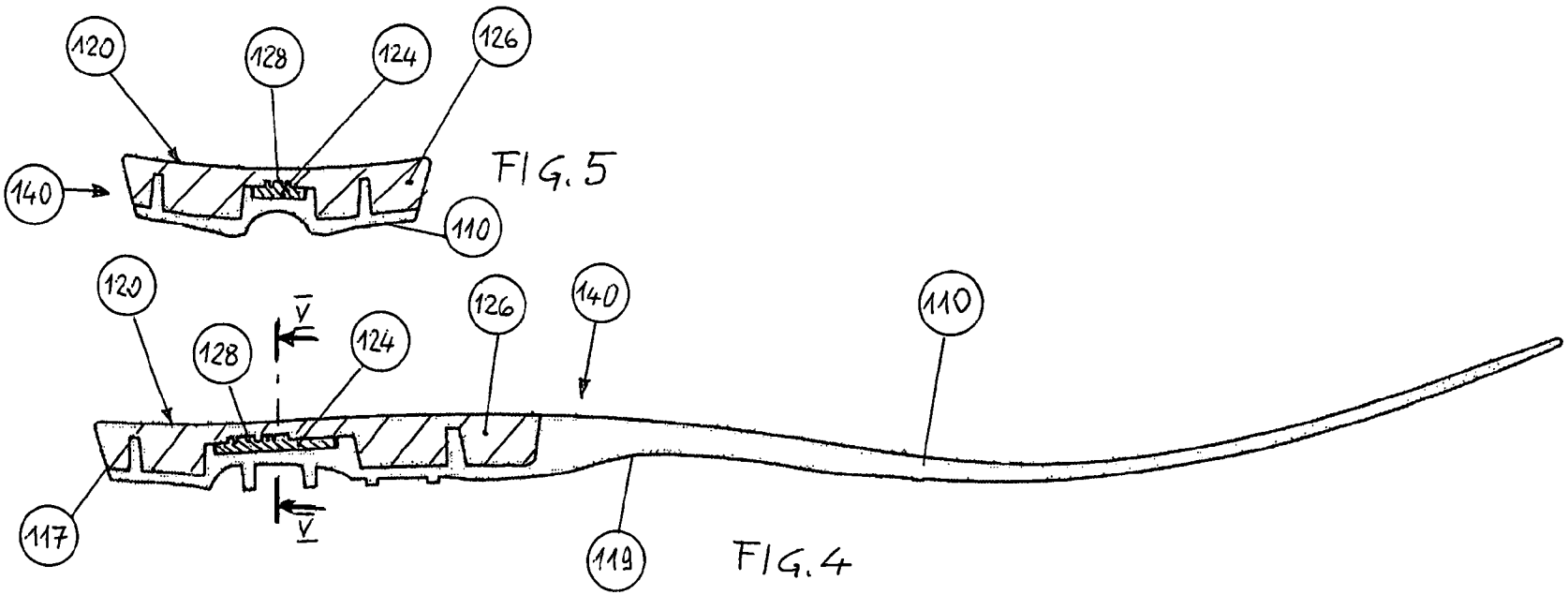
FIG. 4 shows a longitudinal cross-sectional view similar to that of FIG. 2, but of a variant of the insole.
FIG. 5 shows a cross-sectional view, along the plane V-V of FIG. 4, of the said variant of the insole.

The variant 140 of the insole which is shown in FIGS. 4 and 5 differs from that described above owing to the fact that the soft upper element 120 now extends from the end 117 of the heel to approximately above the foot arch 119 of the rigid bottom element 110 which in this variant also extends as far as the tip of the insole 140. The soft element 120 is preferably formed by an inner core 124 of synthetic materials containing additives which make it substantially opaque and is enclosed in a covering part 126 of synthetic materials containing additives which make it, if not transparent, at least translucent.

The bottom surface 128 of the core 124 may thus be conveniently used in order to show an information of benefit for the person using the shoe, for example an information in the form of alphanumeric characters and/or in the form of graphic symbols such as the model or the size of the shoe, the trademark or logo of the manufacturer, the instructions for use and/or maintenance of the said shoe.

It is understood that the invention may also be realized in different forms, within the scope of protection of the following claims, and may also be used in shoes other than sports shoes. In particular the choice of materials and the extension of the soft element may be effected taking into account various factors associated with the practical use of the shoe, for example the fact that the person using the shoe has a more or less heavy physical constitution or the type of utilization (trekking, mountaineering, walking, etc.) which is envisaged.

The invention claimed is:

1. A shoe comprising:

an upper comprising an outermost part with a peripheral bottom edge and an inner sheath, an outer sole fastened to the upper along said peripheral bottom edge, an insole positioned underneath said inner sheath and therefore inseparable from the upper and consisting of a first element of rigid material and a second element of soft material permanently joined on top of the first element and coextensive thereto, said first element having a bottom surface fitting against the outer sole, an upper surface and a plurality of reliefs projecting from said upper surface into the second element, wherein said plurality of reliefs projecting from the upper surface of the first element comprised in the insole are on the inside of the heel, a row of transverse lugs which are substantially vertical and inclined with respect to the longitudinal center plane of the shoe, and on the outside of the heel, a lug profiled so as to follow a contour of the first element and therefore substantially longitudinal.

2. The shoe according to claim 1, wherein an enlarged central and convex portion for reinforcing the zone of the foot arch is provided at the rear of the substantially longitudinal ribs on said first element comprised in the insole.

3. The shoe according to claim 1, wherein additional reliefs projecting from the upper surface of the first element comprised in the insole are along the outer edge of the forefoot, a plurality of projections of a frustoconical form, in the portion comprised between the outer edge and the inner edge of the forefoot, a plurality of substantially longitudinal ribs and a plurality of transverse ribs.

4. The shoe according to claim 3, wherein said projections of a frustoconical form are arranged in two or more non-aligned rows.

5. The shoe according to claim 1, wherein the second element is comprised of one of rubber, polyurethane and the like expanded materials.

* * * * *